United States Patent [19]

Achelpohl

[11] 3,987,754

[45] Oct. 26, 1976

[54] APPARATUS FOR APPLYING FLUENT THERMOPLASTIC MATERIALS

[75] Inventor: Fritz Achelpohl, Lengerich, Westphalia, Germany

[73] Assignee: Windmoller & Holscher, Lengerich, Westphalia, Germany

[22] Filed: Apr. 29, 1975

[21] Appl. No.: 572,868

[30] Foreign Application Priority Data

May 9, 1974 Germany ..... 2422528

[52] U.S. Cl. ..... 118/410

[51] Int. Cl.[2] ..... B05C 5/02

[58] Field of Search ..... 118/410, 411, 412, 14, 118/241, 323, 321

[56] References Cited

UNITED STATES PATENTS 3,782,599 1/1974 Luginbuhl ..... 118/3 X

FOREIGN PATENTS OR APPLICATIONS 1,211,867 10/1959 France ..... 118/410

1,146,737 4/1963 Germany ..... 118/410

*Primary Examiner*—John P. McIntosh

*Attorney, Agent, or Firm*—Fleit & Jacobson

[57] ABSTRACT

Thermoplastic adhesive which has a tendency to form threads is applied to an article and, after terminating the supply of adhesive, the dispensed but not yet applied portion of adhesive is wiped on part of the article that is as yet free from adhesive. Apparatus for performing this method comprises a rotary cam for projecting an adhesive-applying nozzle towards successive articles moved past the nozzle and then retracting it again. The rotary cam has a first cam track portion governing retraction of the nozzle, a second cam track portion governing projection of the nozzle and an intermediate cam track portion for projecting the nozzle still further, control means being provided for opening valve means when the nozzle is in the projected position governed by said second cam track portion and closing the valve means during said still further projection of the nozzle.

4 Claims, 2 Drawing Figures

APPARATUS FOR APPLYING FLUENT THERMOPLASTIC MATERIALS

Figure 1:
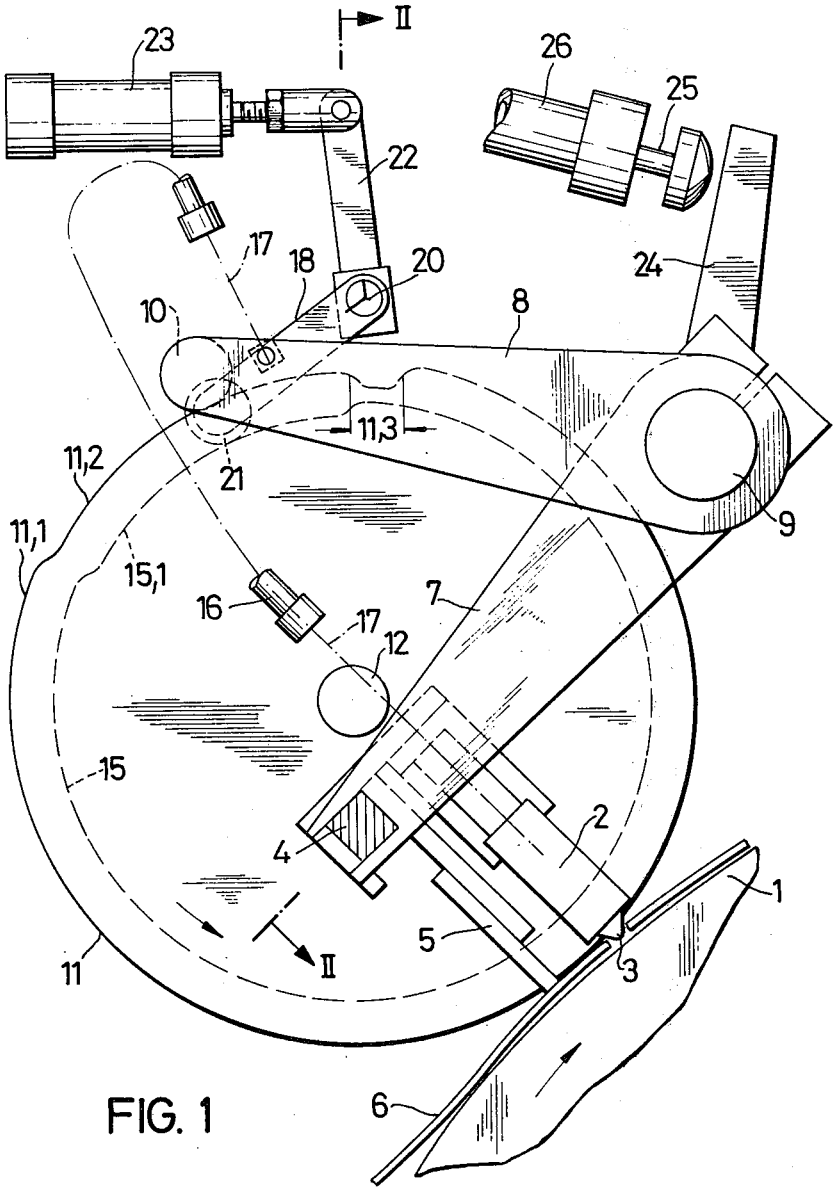

The invention relates to an apparatus for applying to an article fluent thermoplastic adhesive which has a tendency to form threads, for example a hot-melt adhesive, wherein the adhesive is applied and the supply of adhesive is then interrupted until the arrival of a subsequent article. The invention also extends to an apparatus for performing such a method.

German Specification No. 1,063,447 discloses a method in which a nozzle for applying the adhesive is retracted above the application of adhesive for the purpose of breaking the thread that is formed. This known method has the disadvantage that the nozzle must be moved in the direction of travel of the article, which complicates the construction of the apparatus. The thread of adhesive is not broken by this additional nozzle movement because during closure of the adhesive supply valve the adhesive still located in the nozzle orifice is ejected and sticks to the nozzle orifice or the nozzle itself. A thread is then pulled from this additional adhesive, which fails to tear even if the nozzle is moved rapidly. The known method therefore does not avoid the danger of soiling the article or parts of the apparatus with adhesive.

The object of the invention is to provide apparatus by which the formation of threads of adhesive is more positively avoided.

According to the invention, after interruption of the adhesive supply, the apportioned or dispensed but not yet applied portion of the adhesive is wiped on a part of the article that is as yet free from adhesive. The formation of threads is therefore avoided because all remnants of adhesive are wiped on the article.

An apparatus for applying adhesive to a moving article by the aforementioned method comprises a nozzle through an orifice of which the adhesive is applied as the article passes it, a first rotary cam for projecting the nozzle towards the article for application of adhesive and retracting it again, and valve means for opening and closing the nozzle orifice, wherein the first rotary cam is provided with a cam track comprising a first cam portion governing retraction of the nozzle, a second cam portion governing projection of the nozzle and a third cam portion disposed between said first and second cam portions for projecting the nozzle still further, control means being provided for opening said valve means when the nozzle is in the projected position governed by said second cam portion and closing said valve means during said still further projection of the nozzle.

By reason of the fact that the nozzle is advanced further towards the article after the supply of adhesive has been terminated, the remnant of adhesive adjacent the nozzle orifice is wiped off on the article. During retraction of the nozzle by the appropriate portion of the rotary cam, the formation of a thread is not possible because there is no longer any adhesive from which the thread can be formed.

The article to be coated with adhesive by the method or apparatus of the invention can be a continuously moving web or a succession of separate workpieces.

The control means may comprise a second rotary cam rotatable in synchronism with said first rotary cam. Further, means may be provided for closing the valve means independently of the control means and other means may be provided for retracting the nozzle independently of the first rotary cam.

Figure 2:
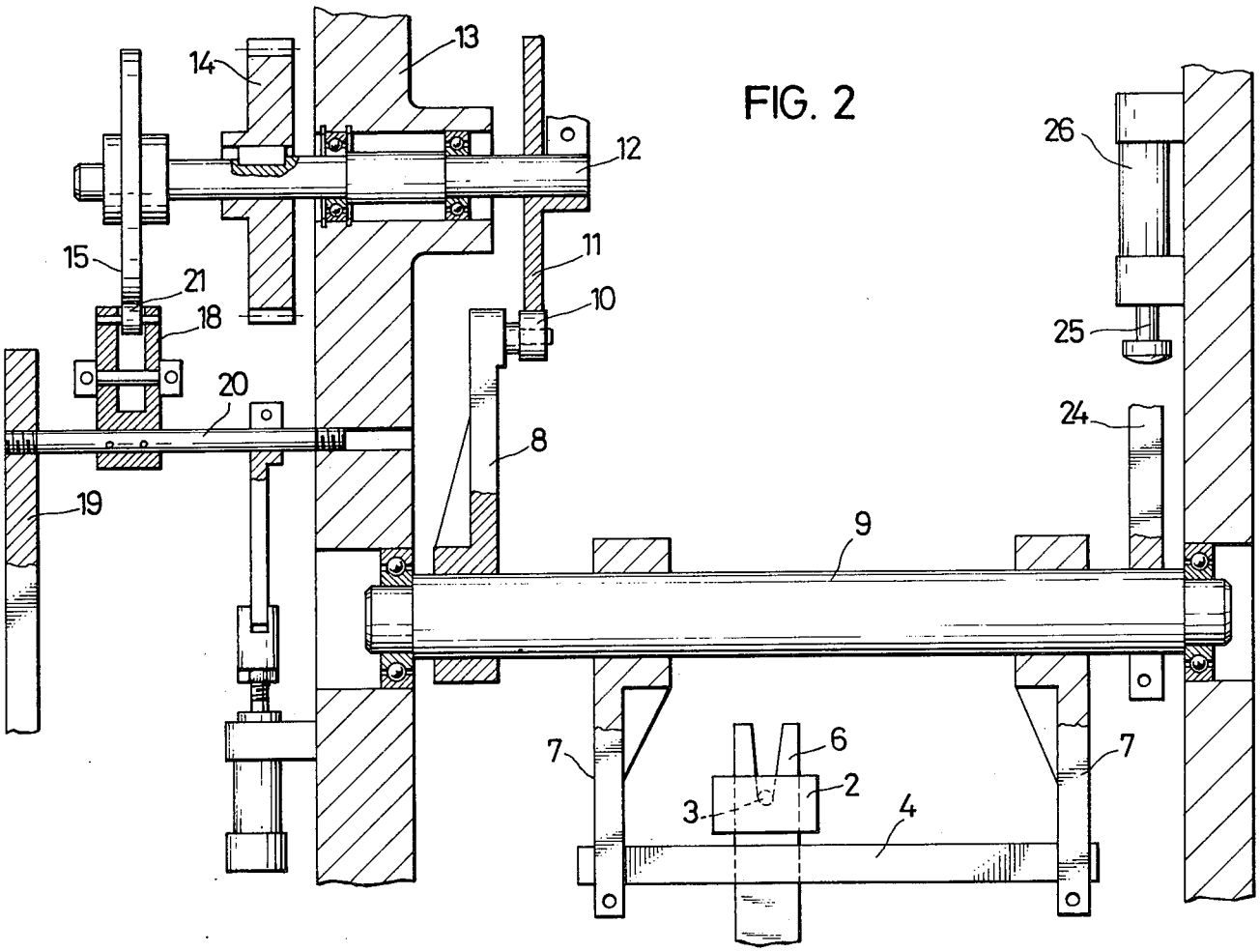

An example of the invention will now be described with reference to the accompanying drawing, wherein:

FIG. 1 is a diagrammatic side elevation of an apparatus for applying thermoplastic adhesive, and FIG. 2 is a section on the line II—II in FIG. 1 to a reduced scale.

The article to be coated with adhesive arrives on a drum 1. A nozzle 2 adjacent the surface of the drum 1 has a nozzle orifice 3 very close to the drum surface. The nozzle orifice can be closed by a valve (not shown). The nozzle 2 is connected to an adhesive supply (not shown) and mounted on a bar 4 which is parallel to the drum axis. The nozzle can be adjusted along the bar 4 and then fixed in position. The nozzle 2 carries a holder 5 carrying a guide plate 6 which lies closely above the surface of the drum 1 and serves to protect the nozzle orifice 3 from damage by the article or articles by holding the latter depressed. The bar 4 is fixed to levers 7 which can be pivoted by a shaft 9 to which a lever 8 is fixed. The lever 8 carries a cam follower roller 10 associated with a cam plate 11. The cam plate 11 is mounted on a shaft 12 which is rotatable in a wall 13 of the frame of the apparatus. The shaft 12 is driven by a gear 14 fixed to it. The shaft 12 also carries a cam plate 15 for controlling a valve for opening and closing the nozzle orifice 3. For the purpose of transmitting the control motion, the core 17 of a Bowden cable 16 is connected between the valve and a lever 18 which is fixed to a shaft 20 rotatable in the wall 13 and a further wall 19 of the frame of the apparatus. The shaft 20 carries a rotatable cam follower roller 21 co-operating with a cam 15 that is also fixed to the shaft 12. Further, a lever 22 is fixed to the shaft 20 and co-operates with a pressure cylinder 23. By actuating the pressure cylinder 23, the valve can be closed independently of the closing brought about by the cam 15, for example when the apparatus is at a standstill.

Fixed to the shaft 9 there is a lever 24 co-operating with the piston rod 25 of a pressure cylinder 26. The latter can also be actuated during standstill of the apparatus and serves to retract the nozzle 2 and guide plate 6 well away from the surface of the drum 1, for example during maintenance work and also to avoid damage of the material of the article or articles therebelow that might be caused by the hot nozzle.

The cam 11 has three dwell positions. During an upper dwell 11.1, the nozzle 2 is retracted from the drum 1. The lower dwell 11.2 causes the nozzle to be projected towards the drum 1 and the article that is to be coated with adhesive. In this position adhesive is applied to the article through the nozzle orifice 3. The lower dwell 11.2 is followed by a cam portion 11.3 by which the nozzle orifice 3 is brought even closer to the article. The cam 15 for controlling the valve comprises a lower dwell 15.1 which commences at the same time as the lower dwell 11.2 of the cam 11, i.e. the valve is opened when the nozzle 2 is in the vicinity of the article. On commencement of the cam portion 11.3, the lower dwell 15.1 terminates, whereby the valve is already closed when the nozzle orifice 3 is brought even closer to the article by the cam portion 11.3. On closure of the valve, the remnant of adhesive in the nozzle orifice is ejected from the latter and wiped on the article to which the nozzle is now very close. Accordingly, when the nozzle 2 is now retracted by the upper dwell 11.1, there is no adhesive from which a thread could be pulled.

I claim:

1. Apparatus for applying adhesive to a moving article comprising a nozzle through an orifice of which the adhesive is applied as the article passes it, a first rotary cam and follower means for projecting the nozzle towards the article for application of adhesive and retracting it again, and valve means for opening and closing the nozzle orifice, wherein said first rotary cam is provided with a cam track comprising a first cam portion governing retraction of the nozzle, a second cam portion governing projection of the nozzle and a third cam portion disposed between said first and second cam portions for projecting the nozzle still further, control means being provided for opening said valve means when the nozzle is in the projected position governed by said second cam portion and closing said valve means during said still further projection of the nozzle.

2. Apparatus according to claim 1, wherein said control means comprise a second rotary cam rotatable in synchronism with said first rotary cam.

3. Apparatus according to claim 1 including means for closing said valve means independently of said control means.

4. Apparatus according to claim 1 including means for retracting the nozzle independently of said first rotary cam.

* * * * *